US009890558B2

(12) United States Patent
Serell

(10) Patent No.: US 9,890,558 B2
(45) Date of Patent: Feb. 13, 2018

(54) ENCODING TOOL FOR A COMBINATION CAP

(71) Applicant: Secure Medication Systems, LLC, Fort Collins, CO (US)

(72) Inventor: Sean Serell, Fort Collins, CO (US)

(73) Assignee: SECURE MEDICATION SYSTEMS, LLC, Fort Collins, CO (US)

( * ) Notice: Subject to any disclaimer, the term of this patent is extended or adjusted under 35 U.S.C. 154(b) by 294 days.

(21) Appl. No.: 14/679,646

(22) Filed: Apr. 6, 2015

(65) Prior Publication Data

US 2015/0300045 A1 Oct. 22, 2015

Related U.S. Application Data

(60) Provisional application No. 61/981,950, filed on Apr. 21, 2014.

(51) Int. Cl.

| | |
|---|---|
| ***E05B 37/00*** | (2006.01) |
| ***B65D 55/14*** | (2006.01) |
| ***E05B 37/02*** | (2006.01) |
| ***E05B 17/00*** | (2006.01) |
| *A61J 1/14* | (2006.01) |

(52) U.S. Cl.

CPC ..... *E05B 37/0048* (2013.01); *B65D 55/145* (2013.01); *E05B 17/0004* (2013.01); *E05B 37/02* (2013.01); *A61J 1/1437* (2013.01)

(58) Field of Classification Search

CPC .. E05B 37/0048; E05B 17/0004; E05B 37/02; B65D 55/145; B65D 55/02; A61J 1/1437; A61J 1/03; Y10T 29/4978; Y10T 70/558; Y10T 70/7322; Y10T 70/5031; B23P 11/00

USPC ..... 83/13, 861, 620, 870, 697, 39, 622, 35; 215/206, 407.1; 30/352

See application file for complete search history.

(56) References Cited

U.S. PATENT DOCUMENTS

| | | | | |
|---|---|---|---|---|
| 3,421,347 | A | 1/1969 | Sotory | |
| 3,684,117 | A | 8/1972 | Leopoldi et al. | |
| 3,782,577 | A | 1/1974 | Levey | |
| 3,828,519 | A | 8/1974 | Levey | |
| 4,354,365 | A | 10/1982 | Mayer et al. | |
| 4,445,348 | A | 5/1984 | Saitoh | |
| 4,473,070 | A * | 9/1984 | Matthews | A61B 17/164 30/352 |
| 4,615,191 | A | 10/1986 | Grandy | |
| 4,625,611 | A * | 12/1986 | Bauman | A61B 1/267 409/300 |
| 5,213,223 | A | 5/1993 | Minnette | |
| 5,277,325 | A | 1/1994 | Yan | |
| 5,284,262 | A | 2/1994 | O'Nan | |
| 6,059,132 | A | 5/2000 | Benjamin | |
| 7,252,204 | B1 | 8/2007 | Small | |
| 2006/0169695 | A1 * | 8/2006 | Roesler | B25H 3/003 220/324 |

(Continued)

*Primary Examiner* — Ghassem Alie

(74) *Attorney, Agent, or Firm* — William W. Cochran; Cochran Freund & Young LLC

(57) ABSTRACT

Disclosed is an encoding tool used to encode a programmable combination locking cap. The encoding tools disclosed have an angled blade and alignment mechanisms so that a combination cap is easily encoded and placed on a container that optionally has an angled blocker so that the angled blocked efficiently blocks the combination of the programmable combination locking cap.

7 Claims, 19 Drawing Sheets

(56) References Cited

U.S. PATENT DOCUMENTS

2013/0062303 A1* 3/2013 Serell ..... A61J 1/03
215/206

* cited by examiner

ENCODING TOOL FOR A COMBINATION CAP

CROSS-REFERENCE TO RELATED APPLICATION

This application is based upon and claims priority to U.S. provisional application Ser. No. 61/981,950, filed Apr. 21, 2014, entitled "Encoding Tool for a Combination Cap," which application is specifically incorporated herein by reference for all that it discloses and teaches.

BACKGROUND OF THE INVENTION

A resistant mechanism on containers may be effective in restricting access to the contents of the container. Restricting access to the contents of a container by children, teenagers, drug addicts and others can be an effective way to protect these contents. Containers, such as prescription bottles, are very common in today's world. Unauthorized access to the containers may pose a safety concern.

SUMMARY OF THE INVENTION

An embodiment of the present invention may therefore comprise an encoding tool for a combination cap comprising: an angled blade; a blade holder; a cap alignment fin; a base; an encoding container secured on the base so that the combination cap is aligned with the cap alignment fin and the angled blade, held securely by the blade holder, so that the angled blade removes encoding tabs located on an interior portion of the combination cap when the combination cap is pushed down on the encoding container, so that the combination cap is encoded by the encoding tool.

An embodiment of the present invention may further comprise a method of encoding a combination cap using an encoding tool comprising: mounting an angled blade securely on a blade holder on an encoding container; forming a cap alignment fin on the encoding container; attaching the encoding container to a base; aligning the combination cap with the cap alignment fin; removing encoding tabs located on an interior portion of the combination cap by pushing the combination cap on the encoding container, so that the angled blade on the encoding container removes encoding tabs on an interior portion of the combination cap to the encoding tool.

An embodiment of the present invention may further comprise an encoding tool for a combination cap comprising: a base; a pivoting arm having alignment flanges that hold the combination cap in a predetermined orientation, the pivoting arm being rotatably mounted to the base; fins located on an interior portion of the alignment flanges that engage with outer grooves located on the combination cap, so that the alignment flanges securely and releasably hold the combination cap in the predetermined orientation; an encoding container mounted on the base; an angled blade; a blade holder mounted on the encoding container that holds the angled blade in a position so that the angled blade removes encoding tabs located on an interior portion of the combination cap when the pivoting arm is pressed onto the encoding container.

An embodiment of the present invention may further comprise a method of encoding a combination cap using an encoding tool comprising: attaching a pivoting arm having alignment flanges to a base so that the pivoting arm is rotatably mounted to the base; engaging fins located on an interior portion of the alignment flanges with outer grooves located on the combination cap, so that the alignment flanges securely hold the combination cap in a predetermined orientation; securing an angled blade with a blade holder on an encoding container, so that the encoding container is securely held by the base; pressing downwardly on the combination cap, so that the angled blade removes encoding tabs located on an interior portion of the combination cap when the combination cap is held in the predetermined orientation, and the combination cap is encoded by the encoding tool.

An embodiment of the present invention may further comprise an encoding tool for a combination cap comprising: a hand depressor; an angled blade; a blade holder that securely holds the angled blade; an encoding tool canister; an internal spring located inside the encoding tool canister, so that the internal spring compresses when force is applied to the hand depressor and the internal spring retracts back to an original position when the force is removed from the hand depressor; canister fins located on the encoding tool canister, so that the canister fins align with alignment grooves located on an interior portion of the combination cap; a cap holder having fins located on an interior portion of the cap holder, so that the combination cap is securely held by the cap holder and the encoding tool can properly encode the combination cap by removing encoding tabs located on an interior portion of the combination cap when force is applied to the hand depressor and the encoding tabs are collected in an opening located on the encoding tool canister.

An embodiment of the present invention may further comprise a method of encoding a combination cap using an encoding tool comprising: exerting a force upon a hand depressor; securing an angled blade within a blade holder that securely holds the blade; providing an encoding tool canister; exerting force on an internal spring located inside the encoding tool canister, so that the internal spring compresses when force is applied to the hand depressor and the internal spring retracts back to an original position when the force is removed from the hand depressor; forming canister fins located on the encoding tool canister, so that the canister fins align with alignment grooves located on an interior portion of the combination cap; aligning a cap holder having fins located on an interior portion of the cap holder, so that the combination cap is securely held by the cap holder and the encoding tool can properly encode the combination cap by effectively removing encoding tabs located on an interior portion of the combination cap when force is applied to the hand depressor and the encoding tabs are collected in an opening located on the encoding tool canister.

DETAILED DESCRIPTION OF THE EMBODIMENTS

Figure 1:
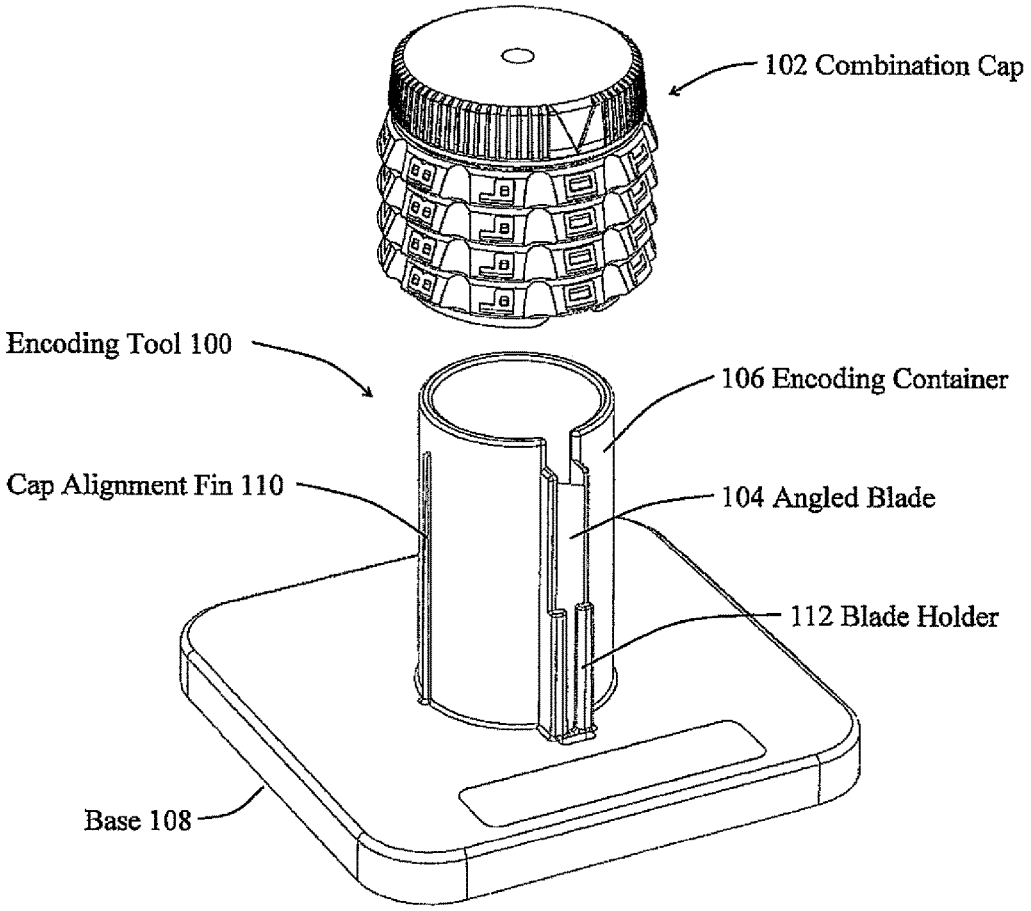
FIG. 1 is an isometric side view of an embodiment of an encoding tool.

FIG. 1 is an isometric side view of an embodiment of an encoding tool 100 that is used to encode a combination cap 102, as disclosed in U.S. patent application Ser. No. 61/533,691, entitled "Container Having a Programmable Combination Locking Cap," filed Sep. 12, 2011, which is incorporated herein by reference for all that it discloses and teaches. Encoding tool 100 is used to encode combination cap 102. Combination cap 102 is aligned with cap alignment fin 110 located on encoding container 106, so that angled blade 104 is able to encode combination cap 102. Blade holder 112 securely encompasses angled blade 104, located on encoding container 106, so that encoding tool 100 can encode combination cap 102 by cutting tabs from an interior portion of the combination cap 102, as disclosed more fully below.

Figure 2:
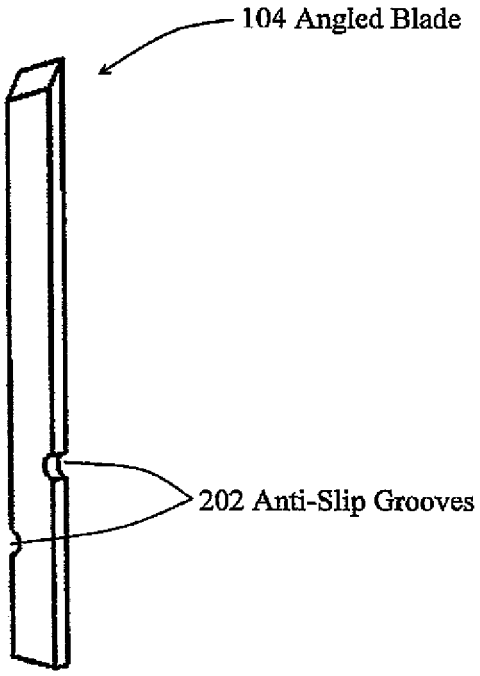
FIG. 2 is an isometric side view of the angled blade of FIG. 1.

FIG. 2 is an isometric side view of angled blade 104 that is disclosed in FIG. 1. Angled blade 104 employs anti-slip grooves 202, so that angled blade 104 is securely held in blade holder 112, as shown in FIG. 1.

Figure 3:
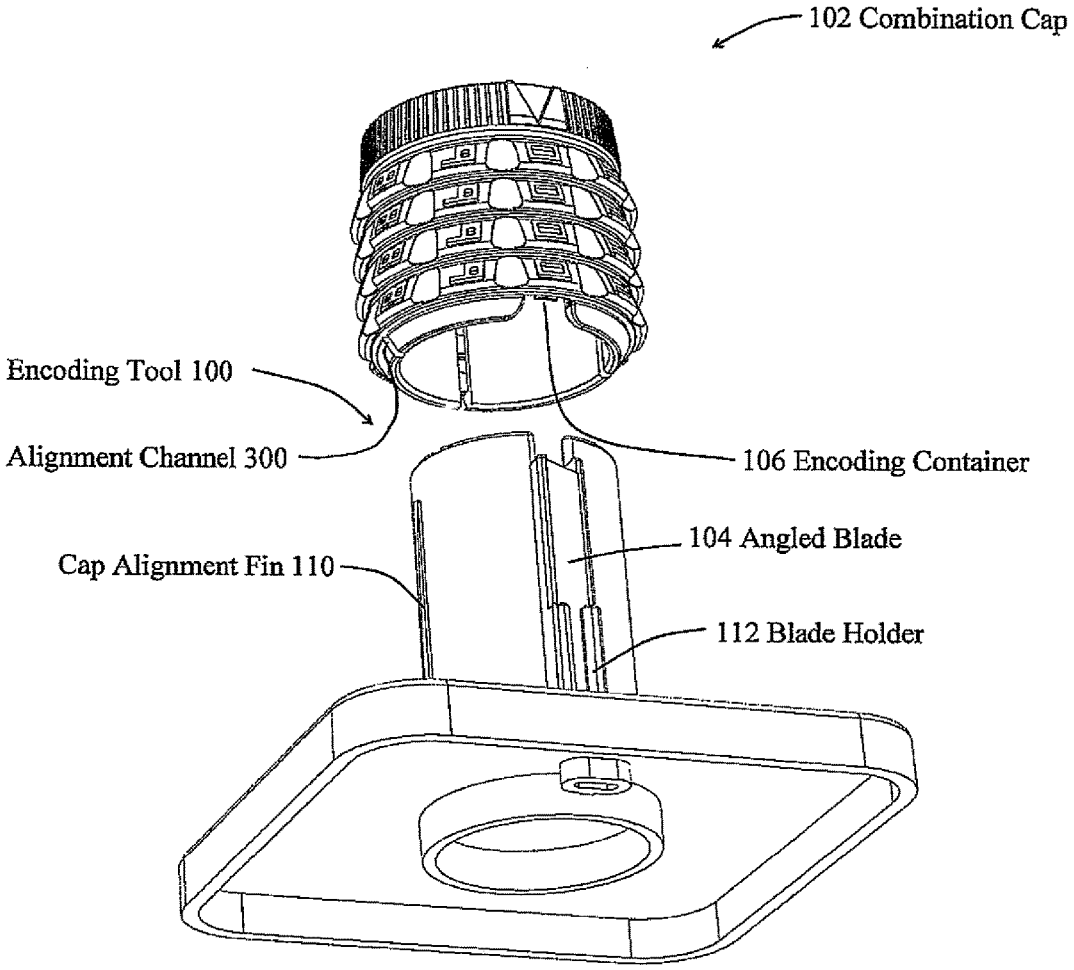
FIG. 3 is an isometric bottom view of the encoding tool of FIG. 1.

FIG. 3 is an isometric bottom view of encoding tool 100. In operation, combination cap 102 has an alignment channel 300, has an alignment channel 300 that properly aligns combination cap 102 on the encoding container 106. When combination cap 102, is pressed downward toward angled blade 104, the encoding tabs 302 are cut from combination cap 102 and encoding tabs 302 fall inside encoding container 106. In this manner, encoding tool 100 encodes combination cap 102 by removing encoding tabs 302 (FIG. 4) from the inside of the combination cap 102 by providing gaps where the encoding tabs have been removed.

Figure 4:
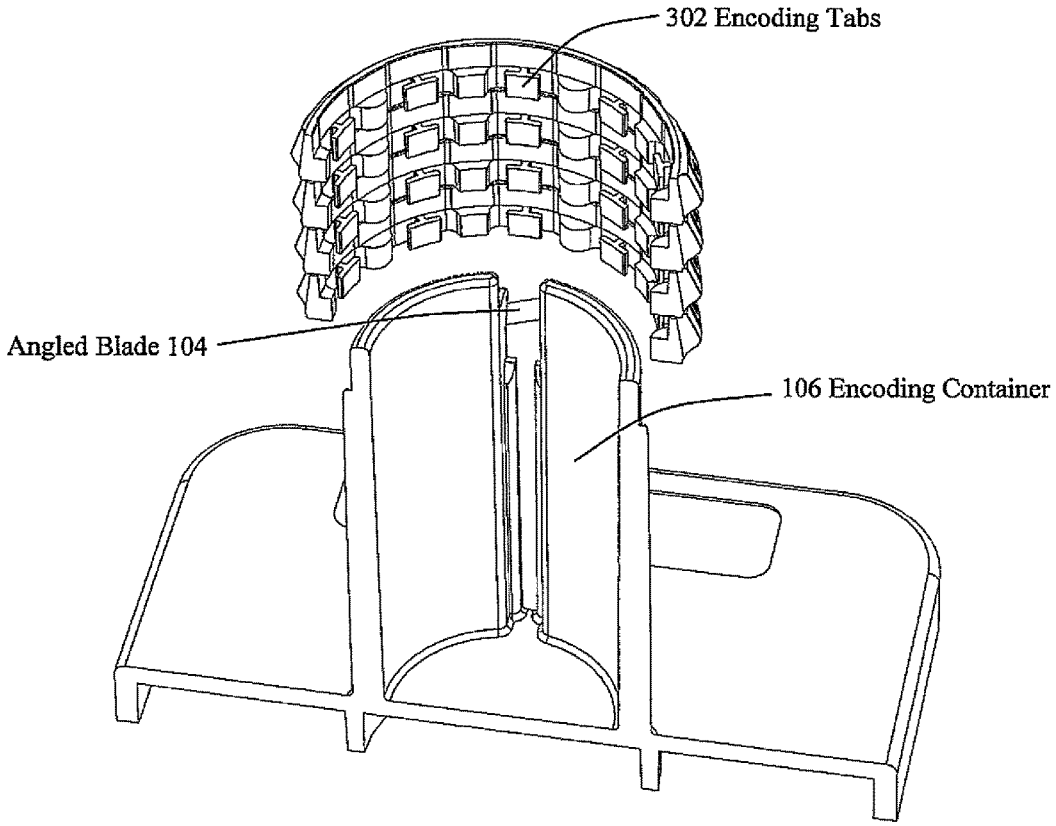
FIG. 4 is an isometric cross-sectional side view of the encoding tool of FIG. 1.

FIG. 4 is an isometric cross-sectional side view showing encoding container 106, angled blade 104, and encoding tabs 302. Encoding tabs 302 are located on the interior of combination cap 102, as shown in FIG. 3. In operation, angled blade 104 removes encoding tabs 302, so that encoding tabs 302 are disposed inside encoding container 106 and provide gaps at the encoding locations on the combination cap 102.

Figure 5:
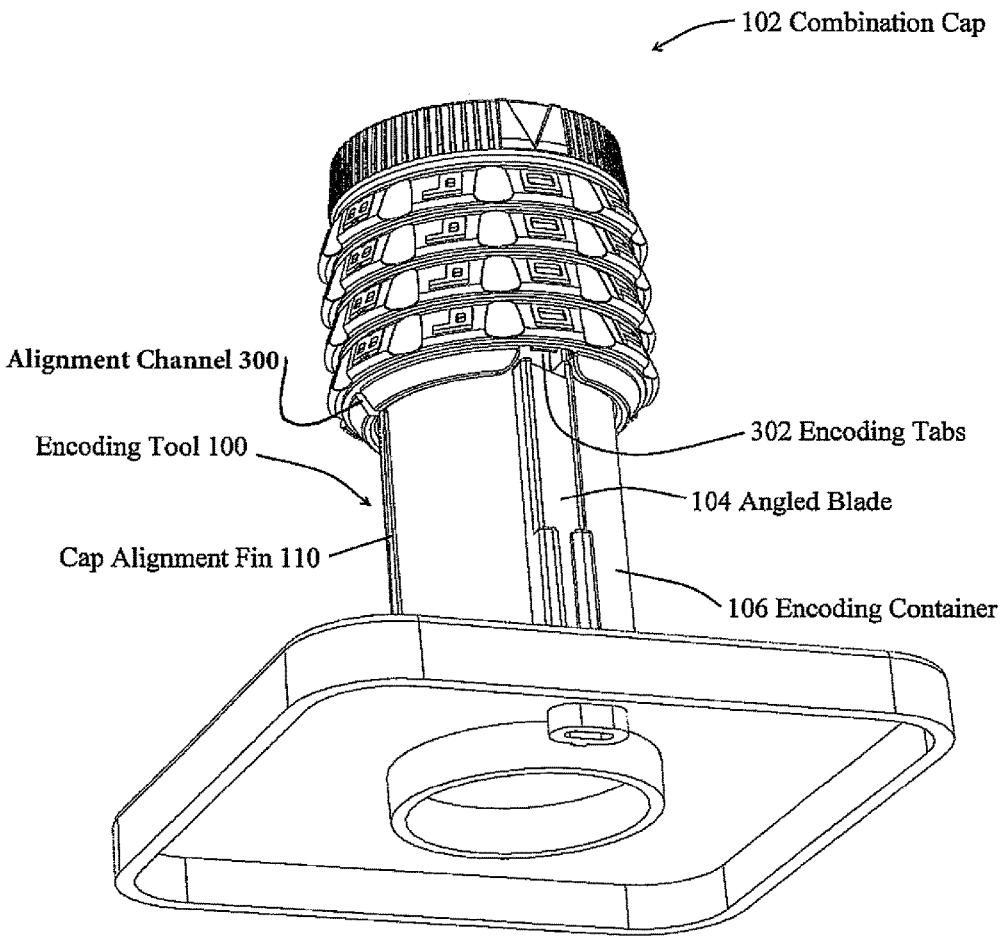
FIG. 5 is an isometric bottom view of the encoding tool, as shown in FIG. 1.

FIG. 5 is an isometric bottom view of encoding tool 100 with combination cap 102 disposed on encoding tool 100. When combination cap 102 is properly aligned with cap alignment fin 110, located on encoding container 106, angled blade 104 removes encoding tabs 302 located on the interior portion of combination cap 102, as the combination cap 102 is pushed down on the encoding tool 100 with the desired code placed in the combination cap 102. The encoding tabs that are cut from the combination cap 102 fall into the interior portion of encoding container 106, so that a user does not have to clean up encoding tabs 302. In other words, encoding tabs 302 are neatly contained inside encoding container 106.

Figure 6:
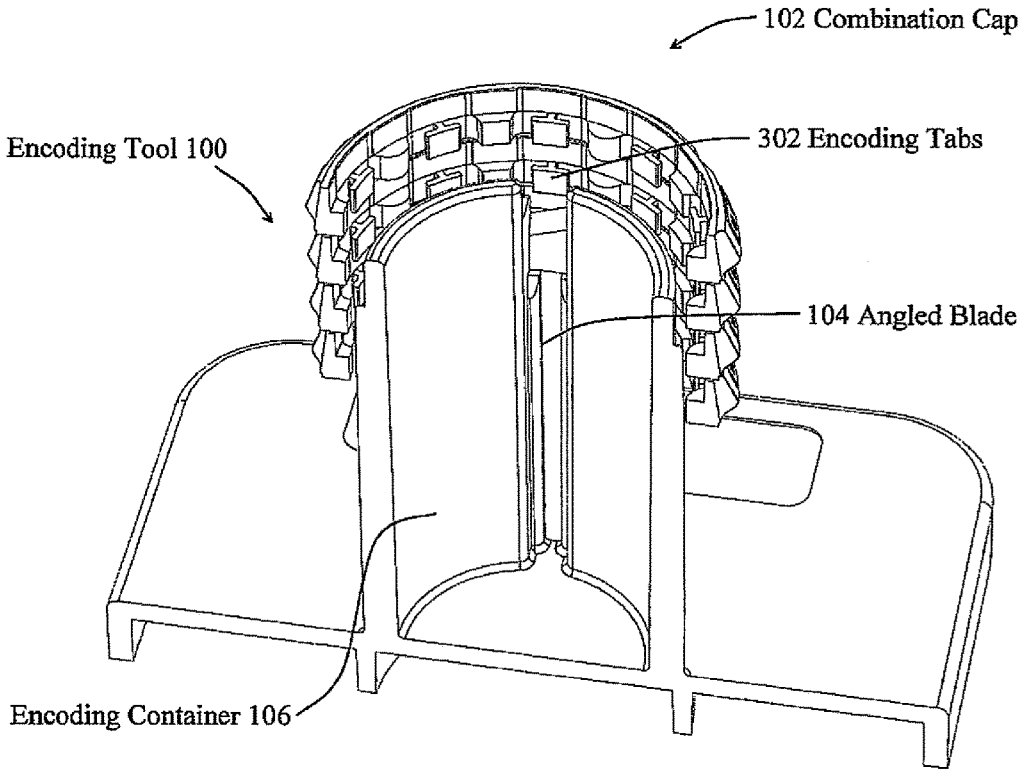
FIG. 6 is an isometric cross-sectional view of the encoding tool of FIG. 1.

FIG. 6 is an isometric cross-sectional side view of encoding tool 100. FIG. 6 further shows encoding tool 100 in operation. As shown in FIG. 6, combination cap 102 is partially pushed down on encoding container 106, so that angled blade 104 can successfully remove encoding tabs 302 and encoding tool 100 can successfully encode combination cap 102, leaving gaps where encoding tabs used to be located.

Figure 7:
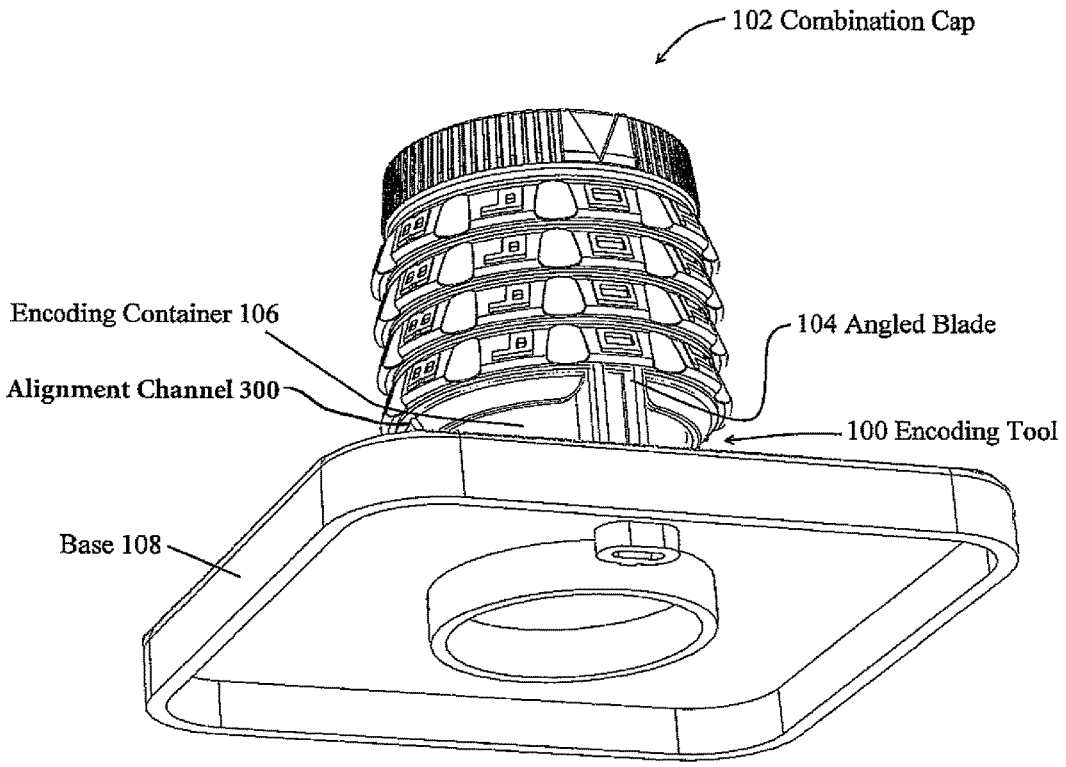
FIG. 7 is an isometric bottom view of the encoding tool of FIG. 1.

FIG. 7 is an isometric bottom view of encoding tool 100. FIG. 7 further demonstrates encoding tool 100 in operation. In other words, combination cap 102 is pushed downward toward base 108, so that encoding tab 302, shown in FIGS. 3, 4, 5 and 6, are removed and fall inside encoding container 106, so that combination cap 102 is properly encoded by removing encoding tabs 302 from the inside of the combination cap 102 by providing gaps where the encoding tabs 302 have been removed.

Figure 8:
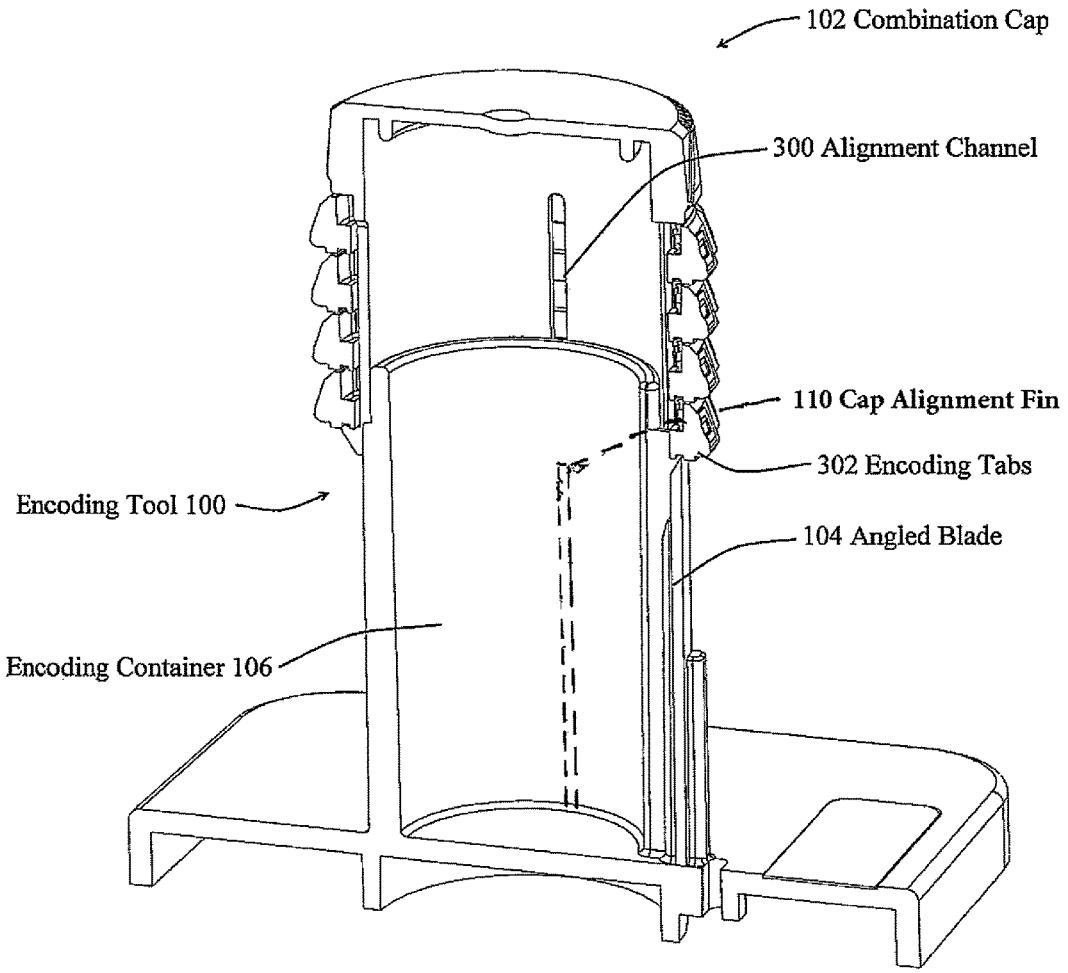
FIG. 8 is an isometric cross-sectional side view of the encoding tool of FIG. 1.

FIG. 8 is an isometric cross-sectional side view of encoding tool 100. As shown in FIG. 8, encoding tabs 302 are properly cut by angled blade 104 and neatly disposed inside encoding container 106. FIG. 8 also shows the interior portion of combination cap and alignment channel 300 that was shown and described in FIG. 3.

Figure 9:
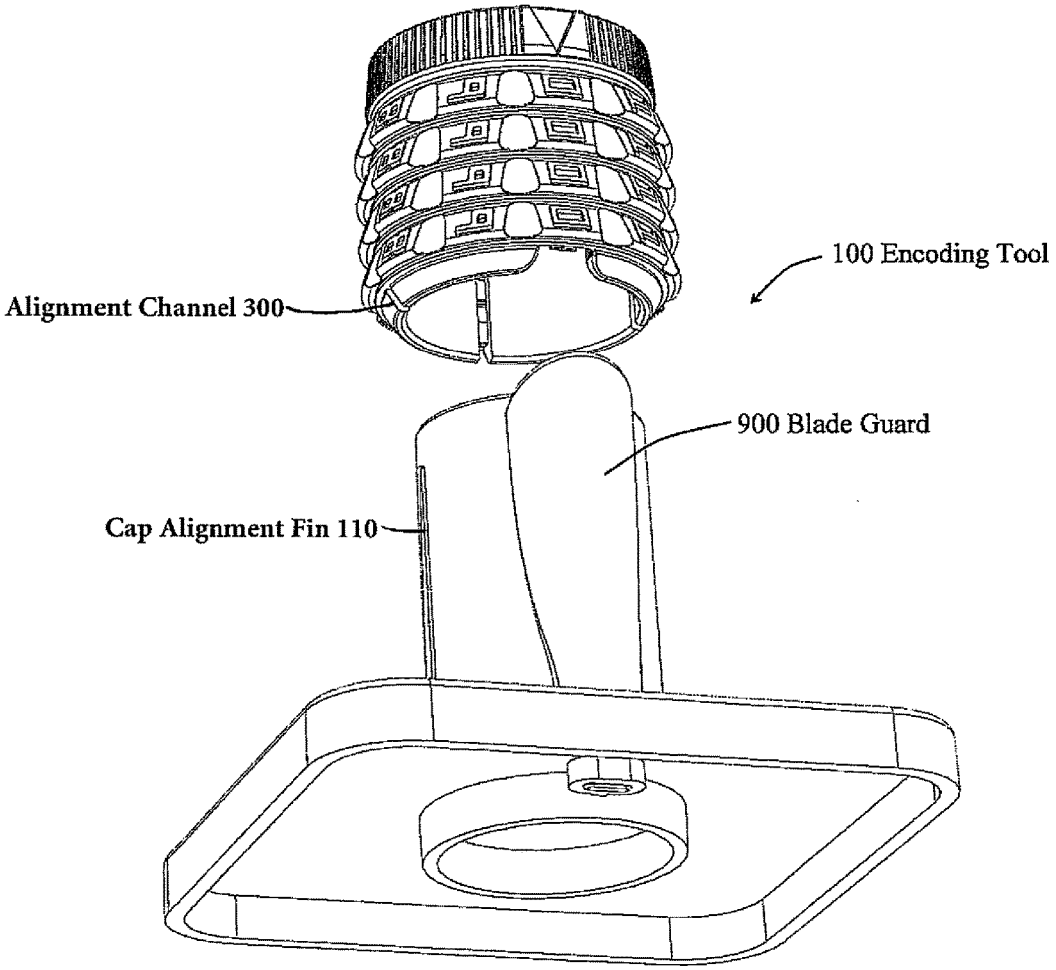
FIG. 9 is an isometric side view of the encoding tool of FIG. 1.

FIG. 9 is an isometric bottom view of encoding tool 100. FIG. 9 is the same embodiment as shown in FIG. 1. However, FIG. 9 shows employing blade guard 900 that covers angled blade 104 disclosed in previous drawings, so that a user is protected from angled blade 104.

Figure 10:
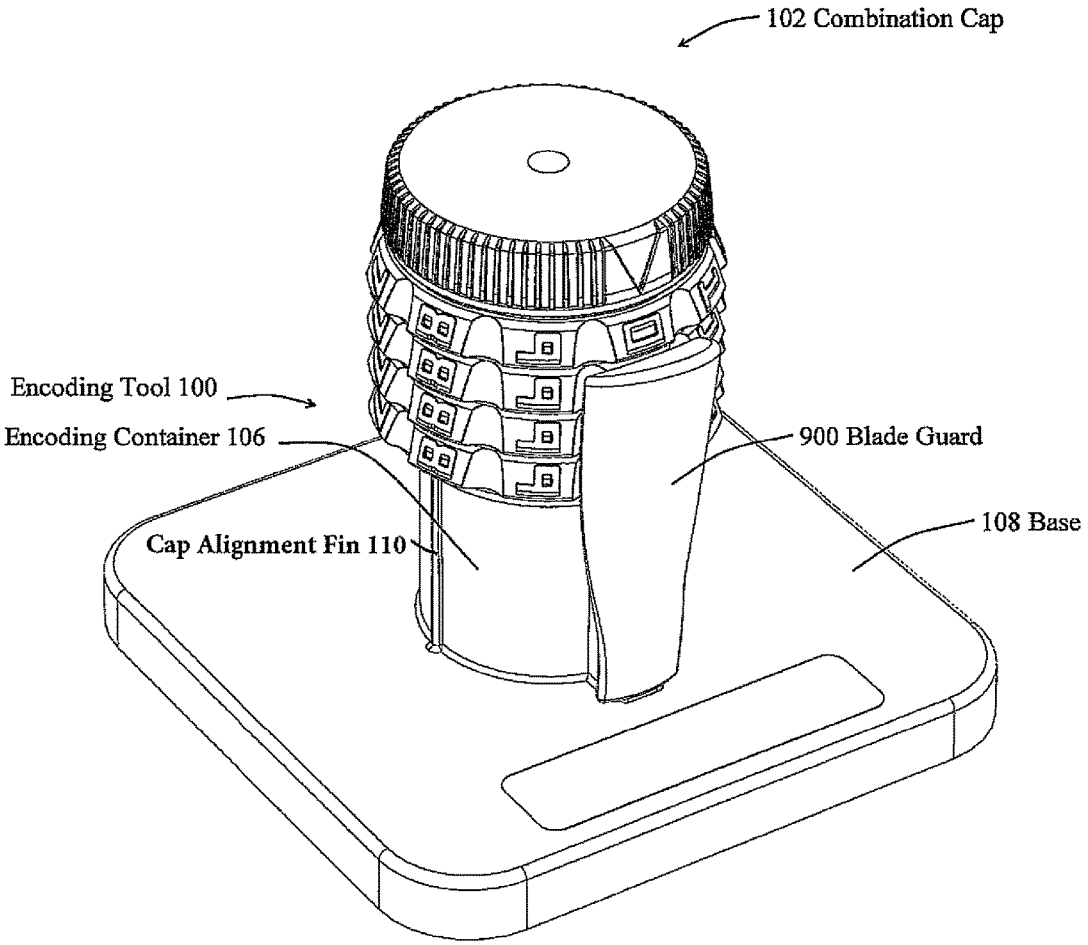
FIG. 10 is an isometric side view of the encoding tool of FIG. 1.

FIG. 10 is an isometric side view of encoding tool 100 in operation. In other words, combination cap 102 is pushed down toward base 108 along encoding container 106 and blade guard 900 protects a user from angled blade 104, as described previously.

Figure 11:
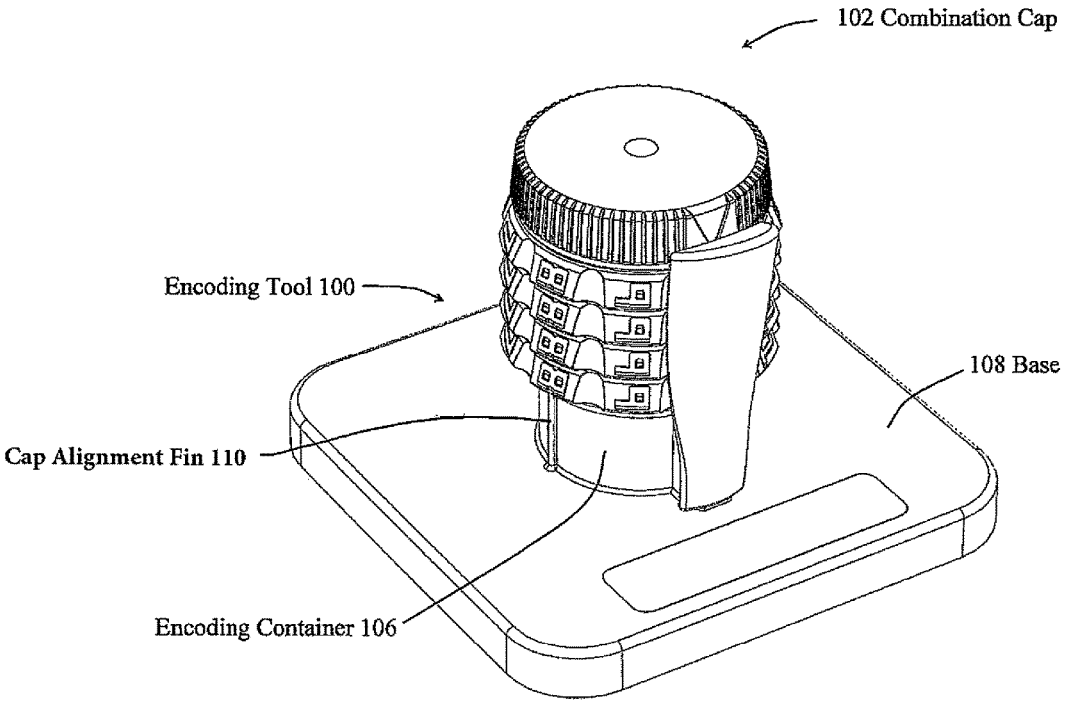
FIG. 11 is an isometric side view of the encoding tool of FIG. 1 with the combination cap fully engaged in the encoding tool.

FIG. 11 is an isometric side view of encoding tool 100 with the combination cap 102 fully engaged in the encoding tool 100. In other words, FIG. 11 shows combination cap 102 fully pushed down toward base 108, so that encoding container 106 encodes the combination cap 102 by removing the tabs on the inside surface of the encoding cap 102. The inside of encoding container 106 was shown in FIG. 4.

Figure 12:
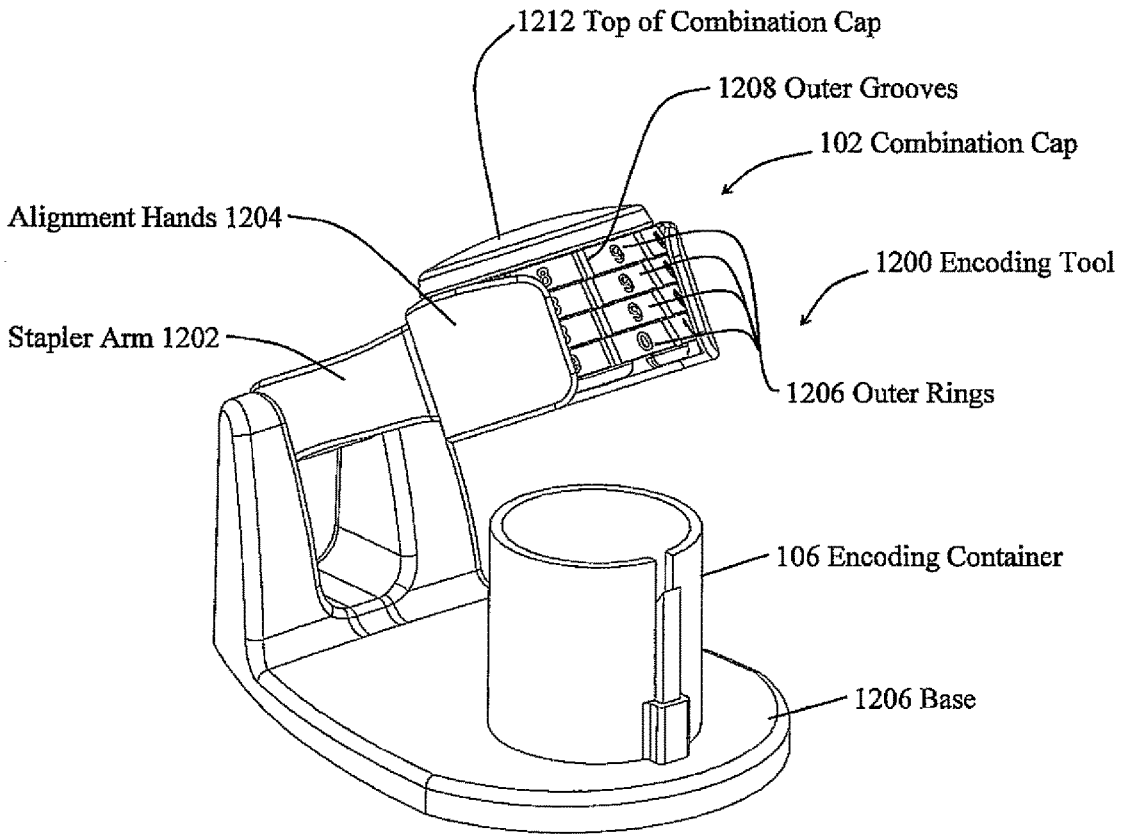
FIG. 12 is an isometric side view of another embodiment of an encoding tool.
Figure 14:
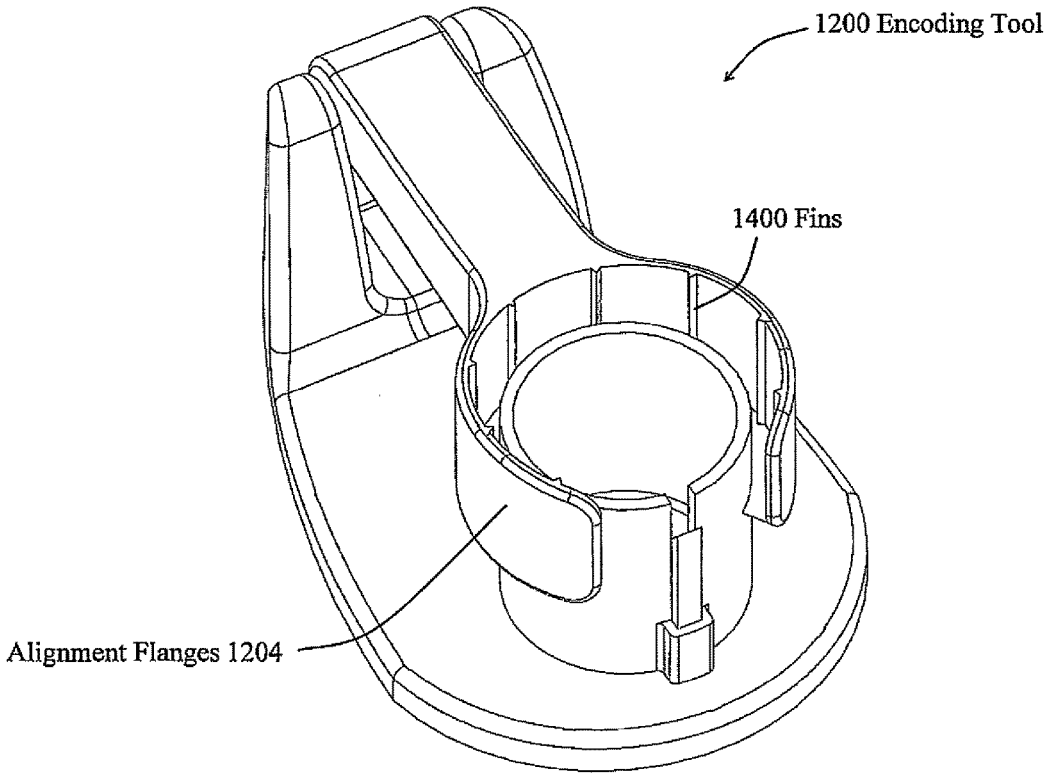
FIG. 14 is an isometric side view of the encoding tool of FIG. 12 without a combination cap.

FIG. 12 is another embodiment of an encoding tool 1200 that encodes a combination cap 102. FIG. 14 is an isometric view of encoding tool 1200. Encoding tool 1200 has a spring loaded stapler arm 1202, alignment hands 1204, and an encoding container 106 that is attached to a base 1206. In operation, outer grooves 1208, that are located between outer rings 1210 of combination cap 102, are properly aligned with fins 1400 (shown in FIG. 14) that are located on an interior portion of alignment hands 1204. Downward force is then applied to the top of combination cap 1212 and alignment hands 1204, toward base 1206, so that combination cap 1202 is encoded in accordance with the code entered into outer rings 1206 by encoding tool 1200.

Figure 13:
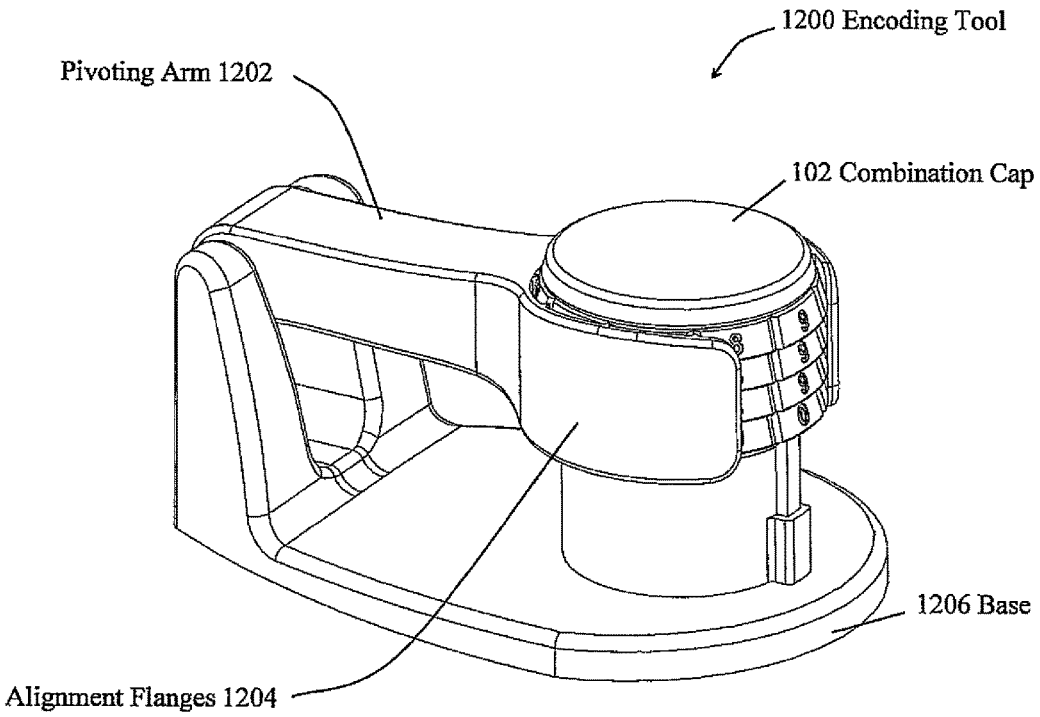
FIG. 13 is an isometric side view of the encoding tool of FIG. 12 that is fully engaged by a combination cap.

FIG. 13 is an isometric view of encoding tool 1200 shown in FIG. 12 that is fully engaged by combination cap 102. In other words, FIG. 13 shows encoding tool 1200 with the combination cap encoded in accordance with the code entered into the encoding rings on the combination cap 102. Combination cap 102 is securely held by alignment flanges 1204, so that combination cap 102 is pushed downwardly by pivoting arm 1202 toward base 1206, which encodes combination cap 102 by removing tabs from the interior part of the combination cap 102.

FIG. 14 is an isometric view of encoding tool 1200, which specifically shows how alignment flanges 1204 are able to securely hold combination cap 102, as shown in FIG. 12. In other words, the interior portion of alignment flanges 1204 show fins 1400 that protrude and properly align with the outer grooves 1208 located between outer rings 1210 on combination cap 102, as was shown and described in FIG. 12. In other words, combination cap 102 has outer rings 1210 that are rotated to a specific, chosen code. When the rings are properly aligned, the outer grooves 1208 are also properly aligned and can engage with protruding fins 1400 to hold the combination cap 102 in a predetermined orientation that corresponds to the selected code and in alignment with the encoding container 106. This allows alignment hands 1204 to securely hold combination cap 102 with the chosen code during the encoding process of removing tabs.

Figure 15:
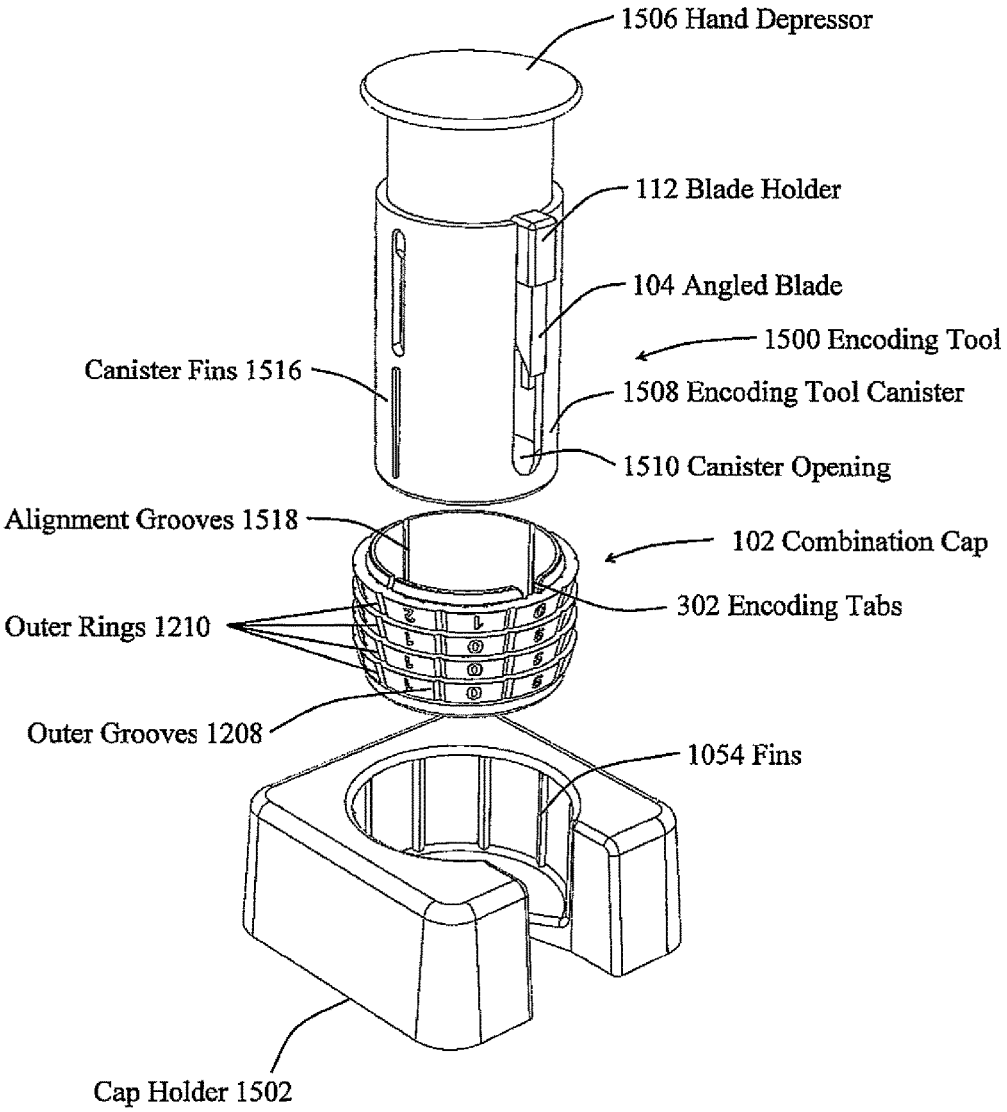
FIG. 15 is an isometric exploded side view of another embodiment of an encoding tool.

FIG. 15 is another embodiment of an encoding tool 1500 that encodes a combination cap 102. FIG. 15 is an isometric view of encoding tool 1500, combination cap 102, and cap holder 1502. Encoding tool 1500 has a hand depressor 1506, an angled blade 104 (held by blade holder 112), an encoding tool canister 1508, which has canister fins 1516, and a canister opening 1510. In operation, canister fins, located on encoding tool 1500, are properly aligned with alignment grooves 1518 on the interior portion of combination cap 102. Outer rings 1210 are rotated on combination cap 102 with the desired code, so that outer grooves 1208 (located on combination cap 102), are properly aligned with fins 1504 (located on the interior portion of cap holder 1502). This allows combination cap 102 to be held securely inside cap holder 1502. In operation, canister fins 1516 are aligned with and slide into alignment grooves 1518 and outer grooves 1208 of combination cap 102 are aligned with and slide into fins 1504 of cap holder 1502. In this manner, the encoding tool canister 1508 is slid inside combination cap 102, and combination cap 102 slides inside cap holder 1502. Hand depressor 1506 is then depressed in a downward motion, so that angled blade 104 can remove encoding tabs 302 (located on combination cap 102). When encoding tabs 302 are removed from the inside of combination cap 102, the encoding tabs 302 fall into a lower portion of canister opening 1510, located on encoding tool 1500. To remove combination cap 102 from encoding tool 1500 and cap holder 1502, encoding tool 1500 is lifted out of cap holder 1502, so that combination cap 102 is encoded, providing gaps at the encoding locations inside combination cap 102.

Figure 16:
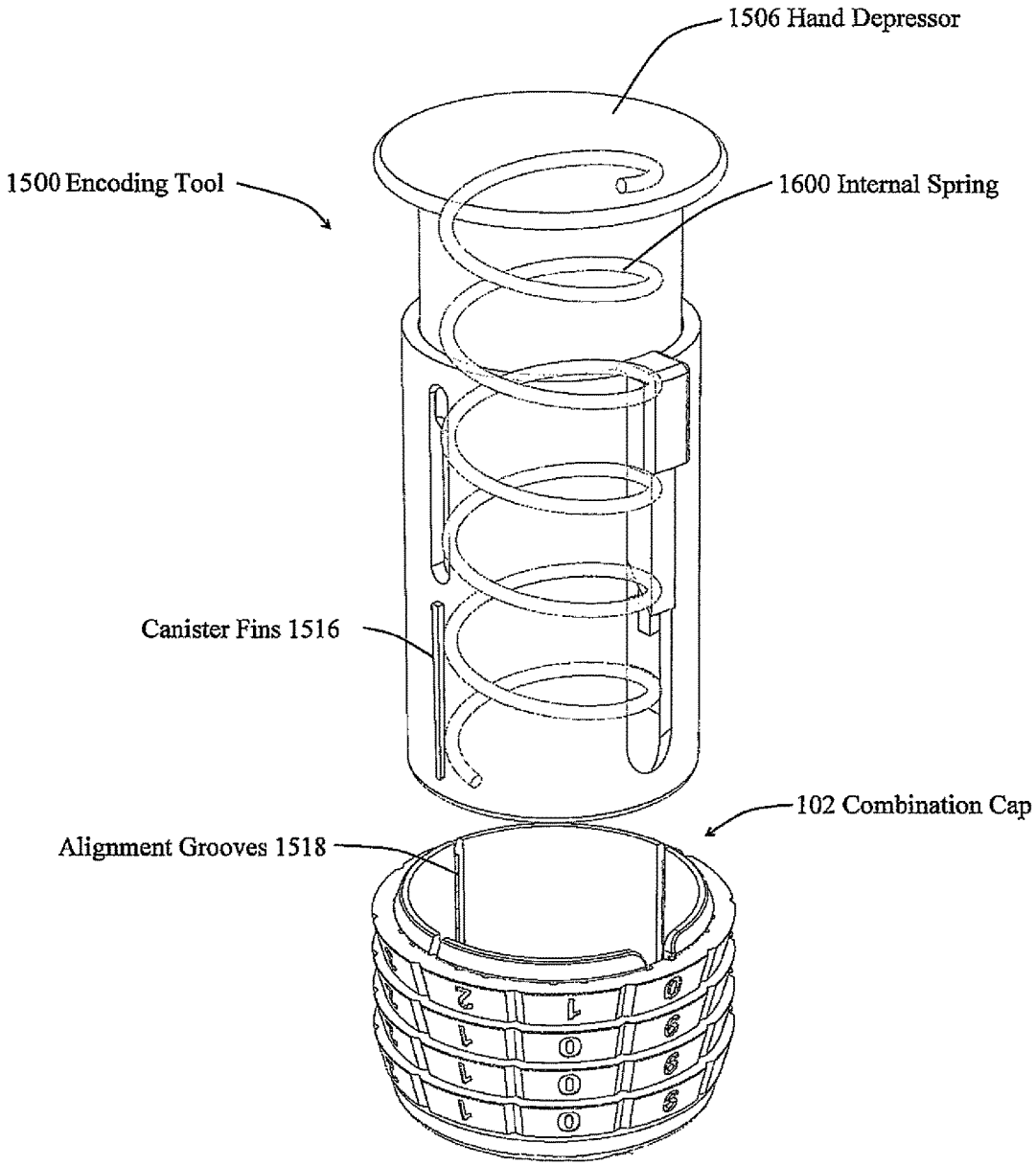
FIG. 16 is an isometric side, transparency view of the encoding tool disclosed in FIG. 15.

FIG. 16 is an isometric, transparent view of encoding tool 1500. FIG. 16 shows an internal spring 1600 located inside encoding tool canister 1508. The internal spring 1600 utilizes spring loaded action to allow cutting of tabs in combination cap 102. When force is applied to hand depressor 1506, internal spring 1600 compresses and springs into a compressed state, which causes the blade to cut the tabs in the interior of the combination cap 102. When pressure is removed from hand depressor 1506, the canister and hand depressor 1506 withdraw from the combination cap 102. In other words, when encoding tool 1500 is properly aligned with combination cap 102 by aligning canister fins 1516 with alignment grooves 1518 of combination cap 102, the internal spring 1600 bounces back to a non-compressed position after hand depressor 1506 has been released.

Figure 17:
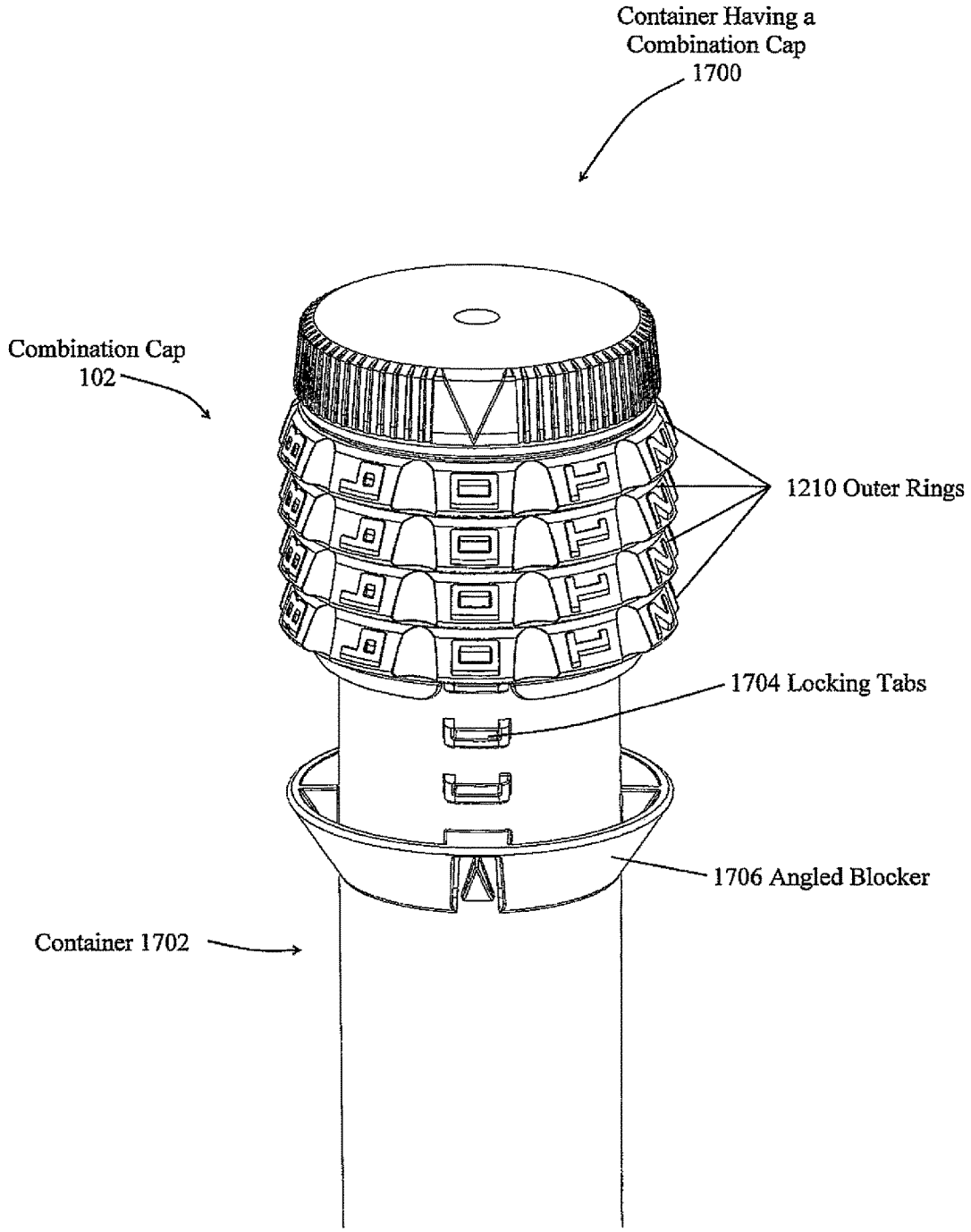
FIG. 17 is an isometric side view of the combination cap disposed on a container.

FIG. 17 is an isometric side view of the combination cap 102 disposed on a container 1702. After combination cap 102 is properly encoded with the selected code, gaps are provided at the encoding locations inside combination cap 102. With the proper combination, combination cap 102 is slid down on container 1702 and locking tabs 1704 slide into the gap that is provided by the removal of the encoding tabs 302. Outer rings 1210 can be rotated causing encoding tabs 302 to engage with locking tabs 1704, so that combination cap 102 is locked onto container 1702. In other words, combination cap 102 can be removed from container 1702 only when outer rings 1210 are properly aligned with the proper code. The proper code of combination cap 102 aligns the gaps that were provided inside combination cap 102 with locking tabs 1704 and combination cap 102 can be removed from container 1702. Angled blocker 1706 is employed on container 1702, so that a user is unable to rotate outer ring 1210 of combination cap 102 and see which tabs have been removed.

Figure 18:
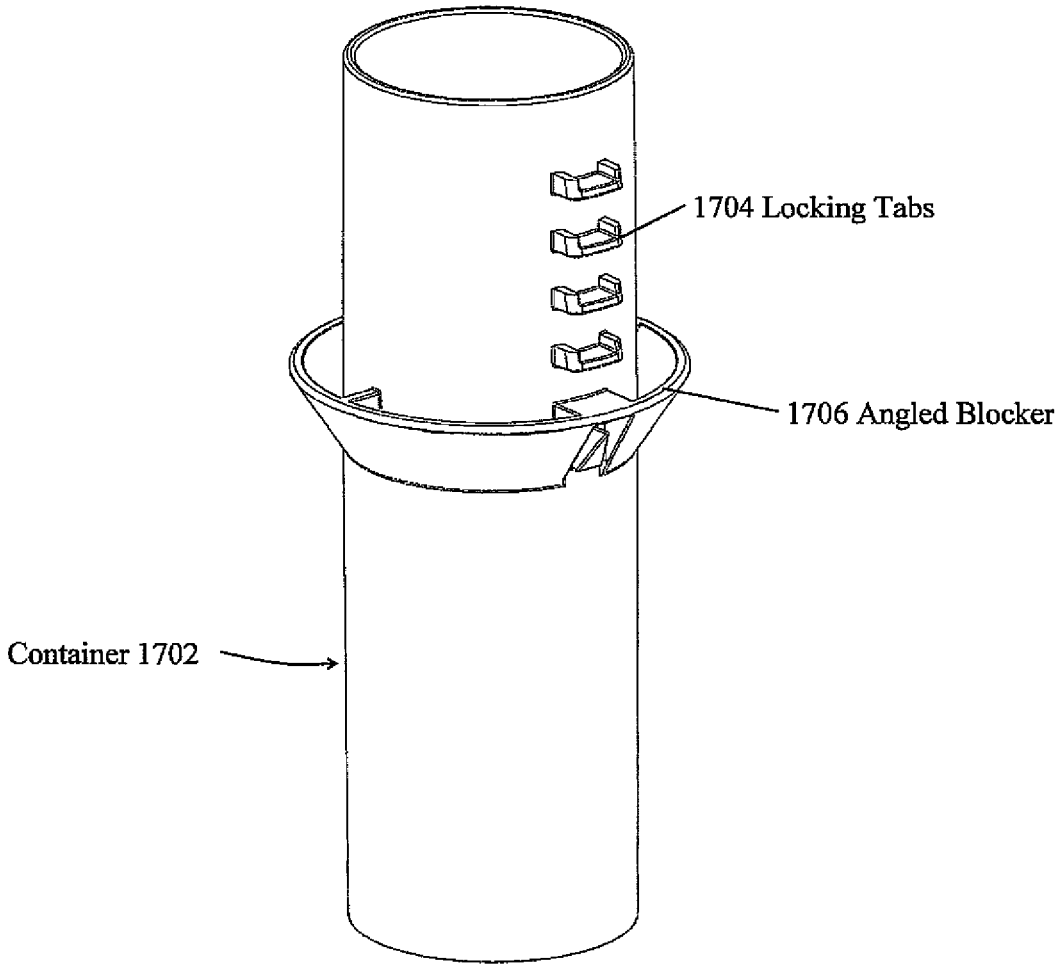
FIG. 18 is an isometric side view of an embodiment of a container.

FIG. 18 is an isometric side view of container 1702 showing locking tabs 1704 and angled blocker 1706. Angled blocker 1706 prevents a user from viewing tabs 1704.

Figure 19:
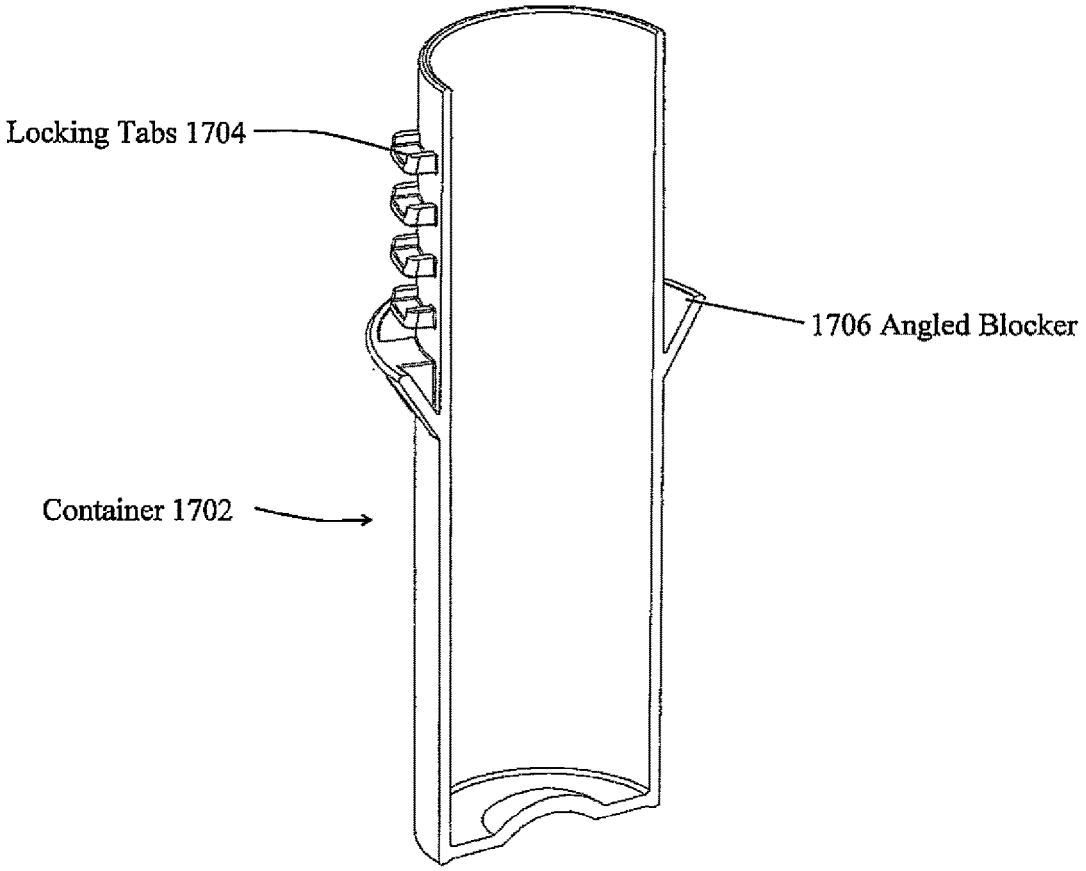
FIG. 19 is an isometric cross-sectional view of the container of FIG. 18.

FIG. 19 is an isometric cross-sectional view showing container 1602. Angled blocker 1606 obstructs the view of locking tabs 1604 and the removed tabs from combination cap 102.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of encoding a combination cap using an encoding tool, the combination cap comprising a tubular cylindrical member with a plurality of indicia rings rotatably mounted thereabout, each of said plurality of indicia rings having a plurality of circumferentially spaced, inwardly projecting encoding tabs; said tubular cylindrical member having an axially extending gap exposing adjacent encoding tabs and having an axially extending alignment channel, the method comprising: mounting an angled blade securely on a blade holder on an encoding container; forming an axially extending cap alignment fin on said encoding container; attaching said encoding container to a base; aligning said axially extending alignment channel on said combination cap with said axially extending cap alignment fin and inserting said axially extending alignment fin into said axially extending alignment channel so that said fin and channel co-act to prevent relative rotation between said encoding container and said tubular cylindrical member of said combination cap and to align said axially extending gap in said tubular member with said angled blade; removing encoding tabs exposed by said axially extending gap by pushing said combination cap on said encoding container, so that said angled blade on said encoding container removes said exposed encoding tabs.

2. The method of claim 1 further comprising: providing a blade guard to properly protect a user from said angled blade.

3. The method of claim 1 further comprising: securing an angled blocker located on a container, so that said angled blocker obstructs the visibility of removed tabs located on an interior portion of said combination cap.

4. An encoding tool for a combination cap comprising:
an angled blade;
a blade holder;
a cap alignment fin;
a base; and
an encoding container secured on said base;
said combination cap comprising a tubular cylindrical member with a plurality of indicia rings rotatably mounted thereabout, each of said plurality of indicia rings having a plurality of circumferentially spaced, inwardly projecting encoding tabs; said tubular cylindrical member having an axially extending gap exposing adjacent encoding tabs and having an axially extending alignment channel;
said encoding container adapted to receive said tubular cylindrical member of said combination cap in encompassing relationship therewith; said cap alignment fin co-acting with said axially extending alignment channel to prevent relative rotation between said encoding container and said combination cap and to place said axially extending gap in alignment with said angled blade, held securely by said blade holder, so that said angled blade removes encoding tabs exposed by said axially extending gap when said combination cap is pushed down on said encoding container, so that said combination cap is encoded by said encoding tool.

5. The encoding tool of claim 4 further comprising: a blade guard that protects said angled blade.

6. The encoding tool of claim 4 further comprising: an angled blocker located on a container that is mounted on said encoding tool canister to obstruct visibility of removed tabs located on an interior portion of said combination cap.

7. A system for producing an encoded combination cap for a bottle comprising:
a combination cap for a bottle including: a tubular cylindrical member with a plurality of indicia rings rotatably mounted thereabout, each of said plurality of indicia rings having a plurality of circumferentially spaced, inwardly projecting encoding tabs; said tubular cylindrical member having an axially extending gap exposing adjacent encoding tabs and having an axially extending alignment channel; and
an encoding tool for a combination cap comprising:
an angled blade;
a blade holder,
a cap alignment fin;
a base; and
an encoding container secured on said base and adapted to receive said tubular cylindrical member of said combination cap in encompassing relationship therewith;
said cap alignment fin of said encoding tool co-acting with said axially extending alignment channel of said cap tubular cylindrical member to prevent relative rotation between said encoding container and said combination cap and to align said axially extending gap with said angled blade, held securely by said blade holder, so that said angled blade removes encoding tabs exposed by said axially extending gap when said combination cap is pushed down on said encoding container, so that said combination cap is encoded by said encoding tool.

* * * * *